United States Patent [19]

Mintz et al.

[11] Patent Number: 5,048,265

[45] Date of Patent: Sep. 17, 1991

[54] METHOD AND APPARATUS FOR FILLING CUSHIONS

[75] Inventors: David Mintz, West Bloomfield; Pierre Tremblay, Howell, both of Mich.

[73] Assignee: Machine Design Systems, Inc., Detroit, Mich.

[21] Appl. No.: 482,361

[22] Filed: Feb. 20, 1990

[51] Int. Cl.[5] ..... B65B 63/02

[52] U.S. Cl. ..... 53/439; 53/258; 53/530

[58] Field of Search ..... 53/255, 257, 258, 436, 53/438, 439, 523, 524, 529, 530

[56] References Cited

U.S. PATENT DOCUMENTS

| | | | |
|---|---|---|---|
| 2,639,073 | 5/1953 | Goldberg | 53/257 X |
| 2,693,304 | 11/1954 | Davis et al. | 53/524 |
| 2,850,857 | 9/1958 | Broyles et al. | 53/530 |
| 2,864,218 | 12/1958 | Wilson et al. | 53/258 X |
| 4,051,644 | 10/1977 | Eide et al. | 53/257 X |
| 4,711,067 | 12/1987 | Magni | 53/439 |
| 4,845,925 | 7/1989 | Thompson | 53/258 X |

*Primary Examiner*—Robert L. Spruill
*Assistant Examiner*—Daniel B. Moon
*Attorney, Agent, or Firm*—Gifford, Groh, Sprinkle, Patmore and Anderson, P.C.

[57] ABSTRACT

A method and apparatus for applying covers to seat cushions and the like includes means to maintain the cushioning material under compression within the cover as the cushioning material is moved into the cover.

11 Claims, 3 Drawing Sheets

METHOD AND APPARATUS FOR FILLING CUSHIONS

BACKGROUND OF THE INVENTION

1. Field of the Invention

The present invention relates to a method and apparatus for applying covers to cushions and, in particular, for applying covers to cushions wherein the cushioning material is maintained under compression within the cover, and the cover is maintained under tension by the cushioning material in the finished product.

2. Prior Art

It has been known to form mattresses and the like by compressing the inner cushioning material and covering the material with a ticking. The compressed material is usually inserted into the ticking by means of conveyor belts or plungers or the like. It is also known to place material in compressed form into containers for shipping or storage. Various apparatuses have been provided, including means placing covers or bags in position and forcing the bags or covers onto the compressible material, or forcing the material into the bags or covers in a compressed form. It is also known to provide seat cushions for motor vehicles and the like wherein the covering material and the resilient cushioning material are so intimately associated that the covering material is under tension and the inner cushioning material is usually under compression. The purpose of this is to ensure conformance of the covering material to the various contours of the cushion. Thus, the covering material and the cushion retain a desired shape or contour, and it is less likely that the covering material will slip over the cushioning material when in use. Chute-like arrangements have also been employed for stuffing cushions. In some instances, the covers or ticking to be stuffed with the cushioning material is placed over the chutes and the cushioning material is forced inwardly of the covering material by means of conveyors or hydraulic or pneumatic cylinders. Various means are provided for ensuring that the covering material is retained in position until the cushion is fully received therein.

SUMMARY OF THE INVENTION

The instant invention pertains to providing seat cushions and the like (arm rests, head rests, etc.) for automobiles or other uses wherein an inner cushion is highly contoured such as to form a "bucket-like seat", and these cushions are covered by fabrics and the like stressed so as to conform to the contours and to adapt to the shape desired. The desired final enclosures are usually achieved by forcing fabric or leather, etc. envelopes over foam-like cushions. The covers are smaller in size than the cushions, so that the cushions will be compressed and the fabric will be tensioned, thus forming a neat seat part which will at all times retain the desired shape with the fabric "following" the cushion material.

Unlike some cushions, such as may be found in household furniture, where some looseness may be tolerated, the finished product must have a taut cover, or at least one that is so anchored to the inner cushion that it will not slip. In some instances, Velcro-like fasteners or hog-rings are used to facilitate maintaining the fabric cover in place with respect to the cushioning material. Whether such fasteners are used or not it is necessary for automotive purposes that means be found for rapidly applying covers, which also provides seats or the like wherein the fabric and cushioning material function are a single unit. There is also a need for a method and apparatus for assembling enclosures and covers without reliance on the brute force of individual operators, and with a minimum of steps.

The instant invention provides a method and apparatus which eliminates reliance on brute force by individual operators and provides a machine which is relatively simple in construction, yet functions in a reliable and efficient manner. Utilizing the concepts of the instant invention, it is possible to build relatively simple machinery and employ simple methods of assembling of cushions.

It has been customary in the automotive industry to simply force covers onto cushions manually. This is a tedious and tiring process. Each cushion must be picked up and the cushion cover must be forced over the cushion from one end to the other by means of tugging and squeezing until the cushion is finally within the cover. One undesirable result of this type of operation is the high instance of injuries, and particularly undesirable is the high instance of Carpal Tunnel Syndrome. This is a syndrome commonly associated with workers whose jobs require excessive use of the hands, fingers and wrists in pulling. The instant invention eliminates the cause of much of this serious injury.

According to the invention, there is provided a method of applying cushion covers wherein a straight line production operation can be realized. According to the invention, covers can be placed in the path of movable cushions in an unstressed state; thus, they can be easily placed in position by operators. Then the cushion can be advanced into the cover utilizing mechanical pressure and means for compressing the cushion so that it can enter the cover. According to the method, a cushion is advanced through a compression zone beyond which the cover is placed. The cushion is advanced through the compression zone into the cover. The cover, in the meantime, is expanded as the oz cushion advances within it, with the cushion eventually contacting a closed end of the cover at which time the cushion is fully within the cover. The cushion, however, does not come into full contact with the cover until after the cushion has moved into contact with the closed end of the cover, and there is further movement of the cushion.

According to the method, a compressible cushion having a preshaped form is placed into a cover which will complement the exterior appearance of the cushion because it is of a smaller size than the cushion and provides a tight fit. In order to unite the cushion and cover, it is o necessary to either expand the cushion cover or compress the cushion. According to the method of the instant invention, the need to manually expand the cover by an operator and place it in a holding chute or channel or the like while a cushion is inserted into it is eliminated. Instead of this, according to the invention, the method consists of placing the cover in an unexpanded state in the path of movement of the foam or the like cushion, which is compressible, holding the cover in position with an open end of the cover facing the oncoming cushion and expanding the cover as the cushion moves along while retaining the cover in position until the cushion reaches the outermost end of the cover. According to the invention, expansion of the cover occurs as the cushion moves into it. This is in contrast with concepts wherein covers are forced onto a preformed cushion without the cushion changing shape, and those concepts wherein the cover must be expanded before being placed in position. Further, neither the cushion nor the cover must be placed on or in means, for tensioning or compressing one or the other and thereafter repositioned before final assembly can be achieved. According to a method of the instant invention, the operator does not find it necessary to considerably stress the cover in placing it in position. Stressing of the cover occurs under the force of the moving cushion.

The invention further provides an apparatus including means for receiving and retaining a cushion cover of a size less than the exterior size of the cushion to which it is to be applied in the path of a moving cushion without stressing of the cushion cover to a larger than normal size throughout its length. The apparatus includes a means for forcing a cushion towards a cover positioned in a primarily unstressed condition in the path of movement of the cushion. The cushion is moved through a means for compressing the cushion, and then the cushion is moved forwardly into the cover without substantially contacting the cover until the cushion has moved to the closed end of the cover and engaged the latter end. The apparatus comprises means for gradually expanding the cover around the cushion as the cushion moves forward but without materially contacting the cushion until the cushion reaches the closed end of the cover. Thereafter, upon continued movement of the cushion, now carrying the cover with it, the cover is stripped off a portion of the machine and into intimate contact with the cushion. According to the invention, expansion of the cover is accomplished by movement of the cushion within the cover while the cover remains in a fixed position. The apparatus embodies means for transmitting the force of the cushion, which is compressed to the cover without contact between the cover and the cushion and while the cushion is moving within the cover and the cover is retained in a fixed position.

DESCRIPTION OF THE PREFERRED EMBODIMENT

Figure 1:
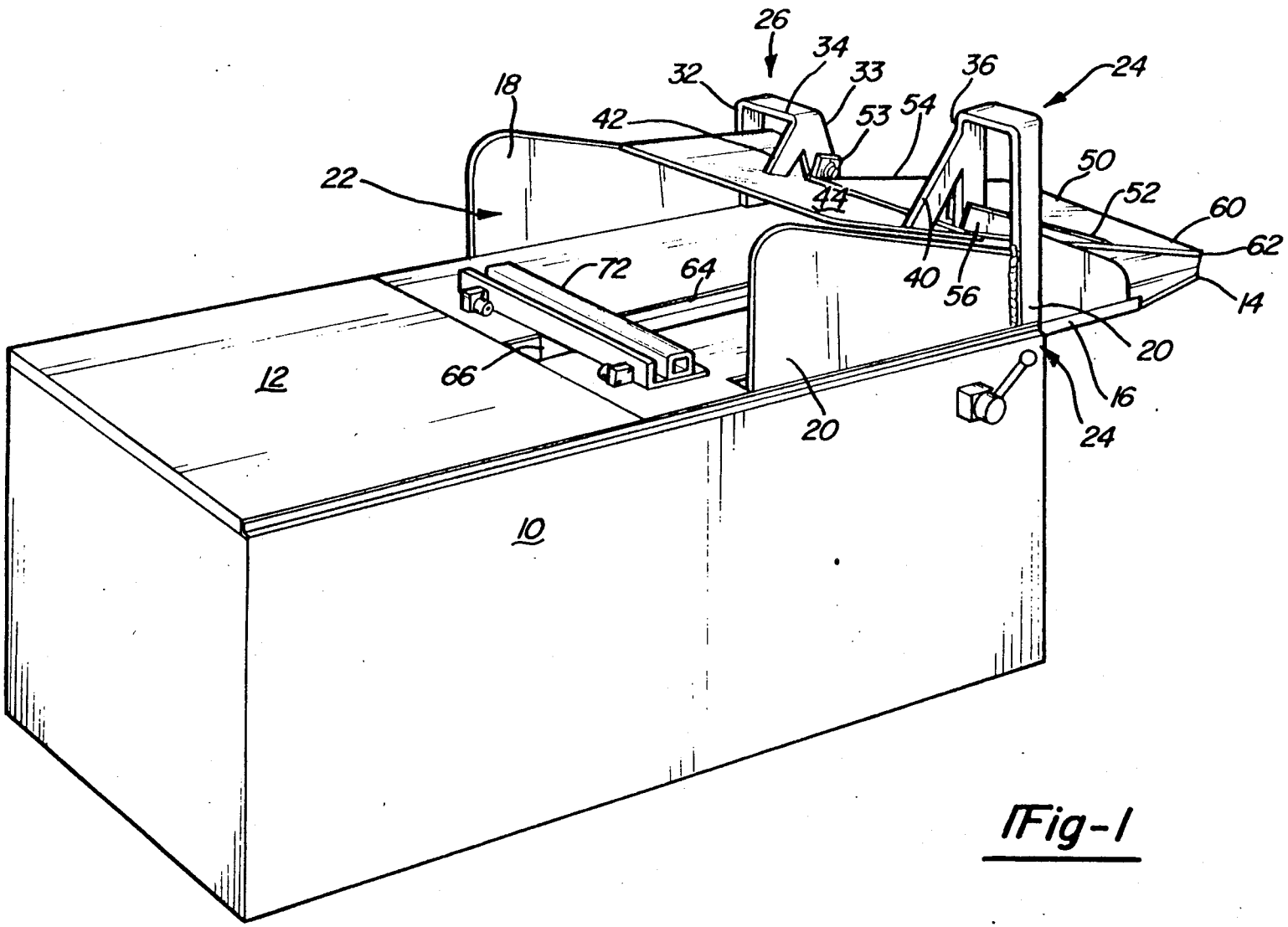
FIG. 1 is a perspective view of a preferred form of the apparatus according to the invention.

A stuffing machine according to the invention comprises a base 10 having an upper platform 12 comprising a forwardly extending portion 14. A pair of spaced side plates 18 and 20 extend upwardly from base 12 and form therewith a channel 22. Upstanding brackets 24 and 26 are attached to side plates 18 and 20 respectively and to base 10. The brackets comprise vertically extending legs 28 and 30, horizontal arms 32 and 34 and depending legs 36 and 38. Legs 36 and 38 and associated reinforcing brackets 40 and 42 fixedly support compression plate 44. Plate 44 is substantially a flat plate-like member and is supported at an acute angle with respect to the platform 12. Plate 44 forms with side plates 18 and 20 and base 12 a channel for receiving a cushion 45 (FIG. 6) which is to be placed within a cover. The plate 44 is angled so that the cushion 45 will be compressed as it moves across the platform 12 forwardly, from the left as viewed in FIG. 1, through the channel 22 and beneath the plate 44. Brackets 24 and 26 are provided with horizontal members 32 and 34 of sufficient length to space the plate 44 inwardly from the side plates 18 and 20 sufficiently to provide passageways 46 and 48, FIG. 2, between the plate 44 and the side plates 18 and 20. The passageways 46, 48 provide clearance for bracket structures and control arms and the like that are often attached to cushion frames or cushions which are used in forming seats in the automotive field as is well-known in the art. The horizontal legs 32 and 34 are positioned upwardly of this channel by means of the depending legs 36 and 38 to also facilitate movement of these attachments with a cushion which may be forced from the left side of the apparatus as shown in FIG. 1 towards the right side as will be described hereinafter.

An upper plate-like member 50 comprising substantially a flat plate is seen to have rear reinforcing members 52 and 54 which provide bosses for pivotally mounting plate-like member 50 upon pins 56 and 58 supported by the depending legs 36 and 38 of the brackets 24 and 26.

Figure 2:
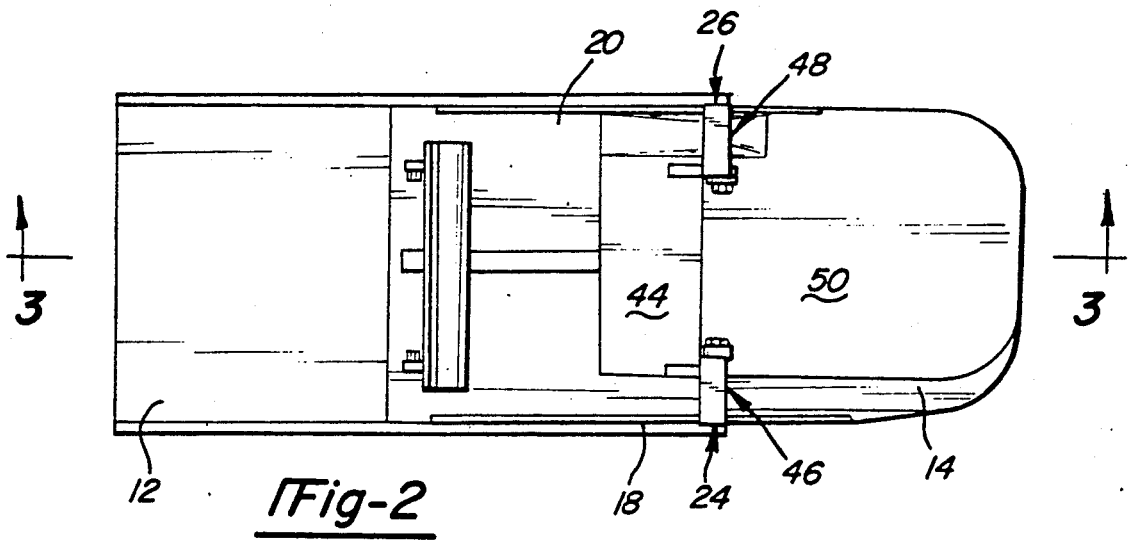
FIG. 2 is a top plan view thereof.
Figure 3:
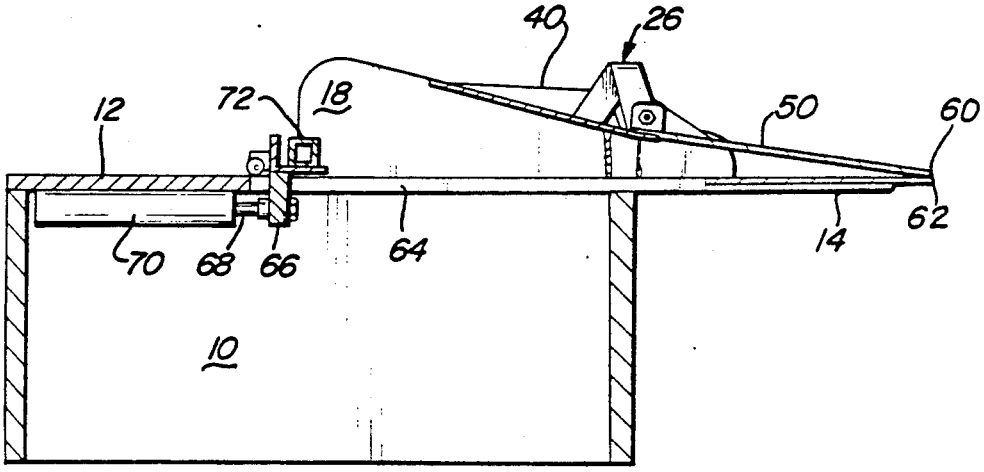
FIG. 3 is a fragmentary sectional view thereof taken along line 3—3 of FIG. 2.
Figure 4:
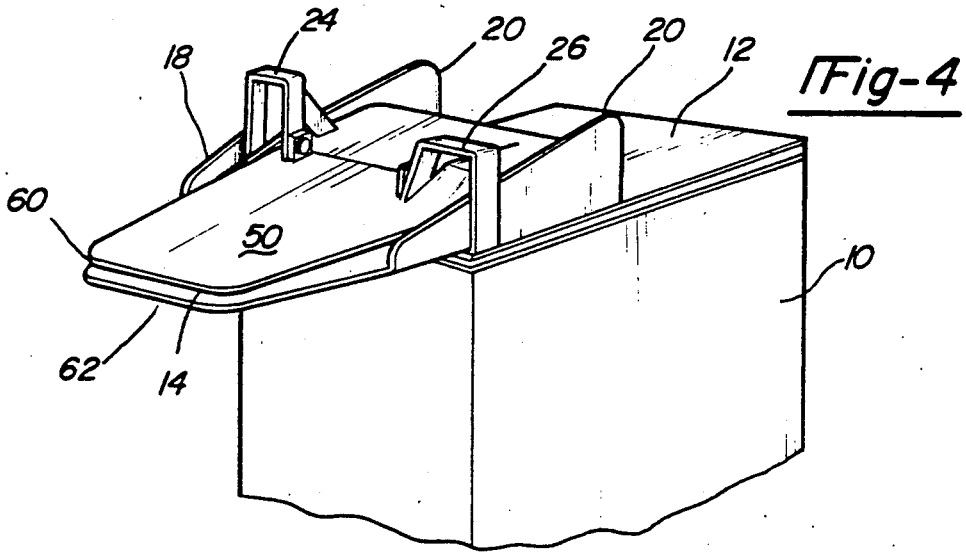
FIG. 4 is a perspective view from a side opposite that shown in FIG. 1.

The plate 50 freely pivots about the pins 56 and 58 and normally plate 50 lies as shown in FIG. 1 with its rearward end 60 bearing on the mating rearward end 62 of the lower plate 14. In any event, plate 50 is substantially closer to plate 14 at its rearward end 60 than it is at the point of pivotal connection to the brackets 24 and 26. As illustrated in FIG. 4 the plate 50 can be pivoted so that its rearward end lies substantially above the rearward end 62 of the plate 14. Referring particularly to FIGS. 1 and 2, it will be seen there is a longitudinally extending slot 64 provided in the platform 12 which extends rearwardly from the extending portion of the platform 12 and adjacent the forward edges of the side plates 18 and 20. Post 66 extends vertically within slot 64 and on its lower end is attached to a piston rod 68 of hydraulic motor 70 (FIG. 3). It will be seen that post 66 can be moved within the slot 64 by the hydraulic cylinder 70. At its upper end the post 66 supports a pusher bar 72. Bar 72 will travel with the post 66 and is adapted to push a cushion such as in FIGS. 5–6 beneath plate 44 and into the space between the plate-like members 14 and 50.

Figure 5:
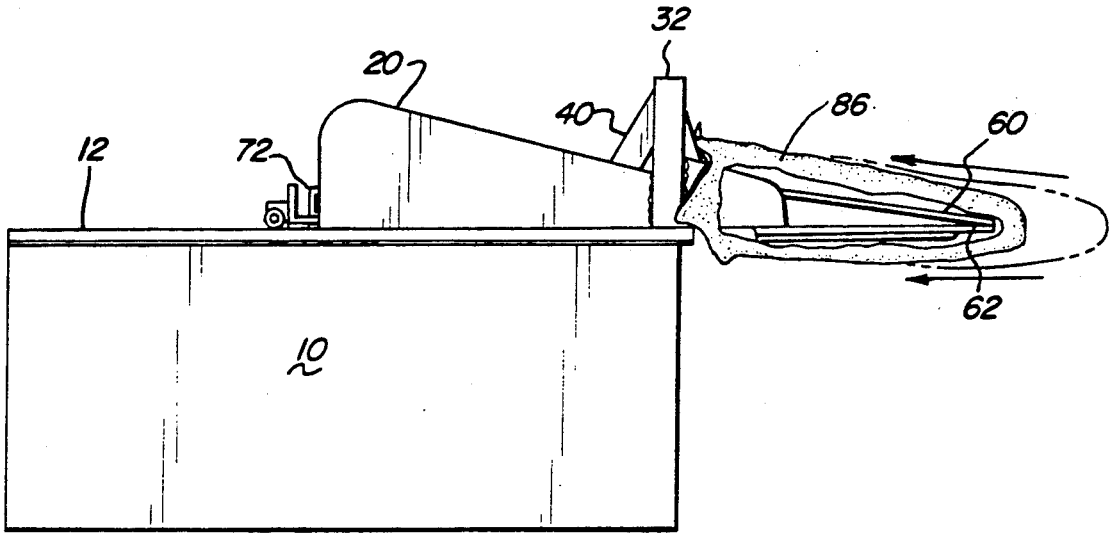
FIG. 5 is a view showing a cover placed in position on the apparatus.
Figure 6:
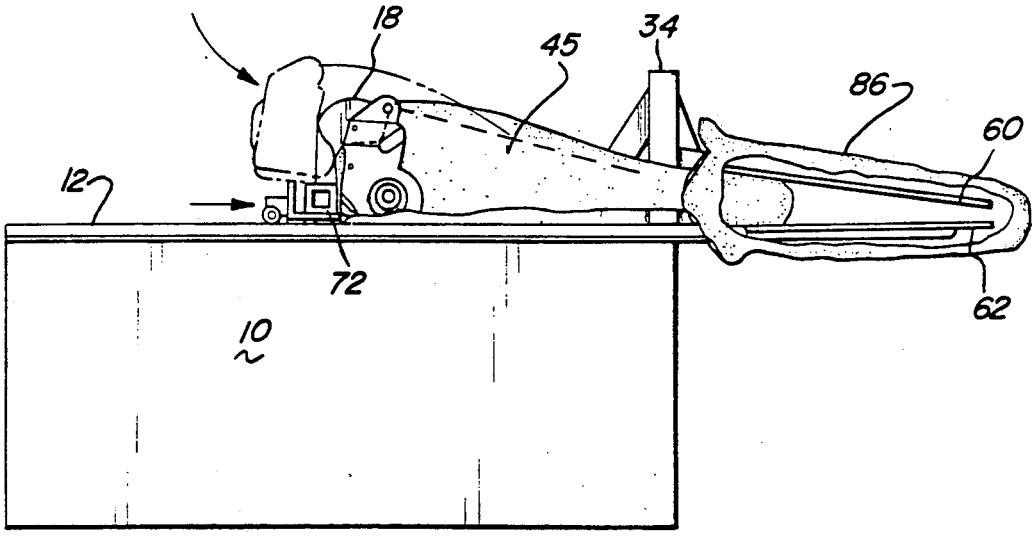
FIG. 6 is a view showing a cushion inserted into the apparatus.

FIG. 6 shows a cushion 45 positioned within the channel 22 and engaged by the pusher bar 72 as well as a cover 86 positioned over the plates 50 and 14. In FIG. 5 the cover 86 is seen to have been simply loosely fitted over the two plates 50 and 14.

As is shown in FIG. 6, when the cushion 45 is moved to the right, the cushion 45 moves beneath the compression plate 44 and between the plate-like members 14 and 50. As it moves forwardly beneath the plate-like member 50 under the influence of the pusher bar 72, the plate 50 starts to pivot about the pins 58 and 56 and move away from the plate-like member 14. This movement continues as the cushion 45 moves towards the end of the plates 14 and 50. In so doing, the cover 86 comes under tension from the force applied by the compressed cushion and expands to a size such that the cushion can move within it. At the same time, however, a substantial portion of the cushion 45 is not in contact with the cover 86 until the cushion reaches the edge 60 and 62. At this point, the cushion 45 comes in contact with the closed end of the cover 86. Thereafter, as the cushion 45 continues to move forwardly the cover 86 starts to slide off of the plate 14 and 50 and comes into contact with the cushion 45 which is constantly expanding as it moves outwardly of the ends 60 and 62 of the two plate-like members 14 and 50. The plate-like member 50 has pivoted to such extent by the time the cushion 45 reaches the edges 60 and 62 that the cover 86 is frictionally now engaged by the plates 14, 50. Upon continued movement, the cover 86 will simply slide off of the plate-like members 14, 50 under urging of the cushion 45 and surround the cushion 45 as it does so.

From the above it is seen that there is provided a method and means for applying a cushion cover to a cushion to form a unit in which the cover is so intimately in contact with the cushion that it will conform to the shape of the cushion and will tend to remain in the relatively fixed position with respect to the internally positioned cushion. This is accomplished by providing a cushion cover which is of a smaller size internally than the cushion which it is to cover. According to the invention, however, a cover can be placed in position to receive the larger cushion through an open end of the cover while the cover is in an untensioned stated. Thus the cover can be positioned relatively easily by a worker. Thereafter the cushion can be compressed and forced inwardly of the cover until it is fully within the cover while the cover remains in a fixed position. While forcing the cushion within the cover, the cover is expanded as the cushion moves within it. This expansion occurs without the cushion coming in substantial contact with the cover so only a modest force is needed to retain the cover in position while the cushion moves inwardly of it. The major force which must be exerted upon the cushion cover is that required to expand it so that the cover can receive the cushion but this is supplied without requiring a more substantial force to hold the cushion in position. Only when the cushion is substantially entirely within the cover is the cover contacted by the cushion and the cover and cushion moves off the work station as a single unit. It will be also seen that the force for expanding the cushion cover is actually supplied by the cushion itself. According to the invention an untensioned cover is positioned in the path of movement of a compressed cushion, the cushion is moved inwardly of the cover and the cover expanded as the cushion moves within it without coming in contact with the cushion along substantially a major portion of its surface and thus the tension and loading upon the cushion cover is controlled in such a manner that the major force required is for expanding the cushion to an open size to receive the cushion. As a result, it is extremely easy to position the cover in place and the forces needed to compress and move the cushion within the cover can be supplied by the machine and not by the operator. Further it is easy to hold the cover in position while the cushion is being forced within it. Although the cushion may come in contact with the sides of the cover, a major portion of the cover is not contacted and thus the cushion is relatively free to move within the cover. The expansion of the cover herein occurs after the cover is placed in position to receive the cushion and the cover need not be moved thereafter by the operator The cover does not have to be rotated from an upper to a lower position or vice versa in order to first be placed upon a chamber-like holder which expands the cover to a fully opened position and thereafter be provided with the cushion. The cover and the cushion are simply placed in order for insertion of the cover into the cushion without any further movement being required to align either element with means for pressing one within the other. Further, the placing of the cushion and the cover is relatively easily performed. Relatively modest effort is required to place the cover over the two plate-like members 14 and 50 and position the cushion within the chamber 22 prior to its being pressed rearwardly by the cylinder 70 and the pusher bar 72, as compared to what is required with previously known methods. The force for compressing the cushion expanding the cover and applying the cover to the cushion is supplied by the apparatus and not by the operator. The operator simply has to energize the apparatus to force the cushion from the left as viewed in FIG. 1 towards the right inwardly of the cushion cover in order to obtain the finished product.

Having thus described my invention, many modifications thereto will become apparent to those skilled in the art to which it pertains without deviation from the spirit of the invention as defined by the scope of the appended claims.

We claim:

1. A cushion cover stuffing machine comprising a platform for supporting a compressible cushion, means for inserting said cushion in a compressed state into a cover forming a substantially complete enclosure for said cushion and having an open end and an opposite closed end, said cover being of a size transversely of its length that is less than the uncompressed size of the cushion to be received therein, comprising means for fixedly positioning said cover with its open end directed toward said cushion with said cover in a substantially untensioned state, said fixedly positioning means holding said cover in the latter position, means for positioning said cushion on said platform for movement into said open end of said cover, means for moving said cushion on said platform inwardly of said cover open end in a compressed state towards the opposite closed end of said cover, said fixedly positioning means expanding said cover transversely of its length as said cushion moves therein towards said opposite closed end while said cover remains in a relatively fixed position with respect to said platform, said means for moving said cushion being operative to force said cushion against said closed end of said cover upon further movement of said cushion thereby forcing said cover into contact with said cushion and forcing said cover to move and whereby said cushion moves off said platform and expands within said cover.

2. The cushion stuffing machine of claim 1 including said fixedly positioning means expanding said cover comprising means operably by expansion of said cushion.

3. The cushion stuffing machine of claim 2 wherein said fixedly positioning means expanding said cover includes means for retaining said cover in a relatively fixed position while said cover is expanded by expansion of said cushion.

4. The cushion cover stuffing machine of claim 2 wherein said means for fixedly positioning said cover comprises a pair of facing plate-like members of a length along the path of movement of said cushion sufficient to be encompassed by a substantial portion of said cover lengthwise thereof and having first ends spaced from each other sufficiently to receive said cushion in a compressed state therebetween and forming an open end of said plate-like members, said plate-members having opposed second ends positioned more closely to each other than said first ends are to each other and resisting movement of said cushion to said closed end of said cover, said second ends of said plate-like members being movable with respect to each other by movement of said cushion to a more open relatively spaced condition in which said cushion can move more freely between said second ends, said plate-like members being formed such that when said second ends are adjacent each other said cover in an untensioned state can be freely slipped over said plate-like members, and when said second ends are moved to said more open condition by movement of said cushion said cover is expanded.

5. The cushion stuffing machine of claim 1 wherein said means for moving said cushion in a compressed state comprises a plate-like member facing with said platform and a funnel-like means having an open end positioned in the path of movement of said cushion into said cover.

6. The cushion cover stuffing machine of claim 1 including means for moving said cushion completely inwardly of and toward the closed end of said cover while the compressive force on said cushion is gradually released whereby said cover is forced to move with said cushion and onto said cushion as said cushion expands further within said cover to form a covered cushion in which said cover is in intimate contact with said cushion and follows the contours thereof.

7. The cushion cover stuffing machine of claim 1 including said means for fixedly positioning said cover comprising a pair of facing plate-like members having forward and rearward facing ends extending transversely of the path of movement of said cushion, said forward ends being spread to form an opening for receiving said cushion between said plates as said cushion is forced into said cover, said plate-like members forming a chamber for passage of said cushion therethrough from said forward end to and out of said rearward end of said plate-like members, one of said plate-like members being supported adjacent said forward end for relative pivotal movement of said plate-like members about an axis transverse the line of movement of said cushion for pivotal movement of the latter said plate-like member as said cushion passes through said chamber and the latter said plate-like member being freely pivotable when unsupported by a cushion to a condition in which said plates slope inwardly towards each other from said forward end to said rearward end to an extent that the plate-like members at said rearward end and extending therefrom towards said forward end from an outer periphery transverse their length of an extent less than the unstressed inner periphery of said cover whereby said cover can be freely slipped over said outer ends of said plate-like members.

8. The cushion cover stuffing machine of claim 1 wherein said means for positioning said cover comprises a facing pair of members, one of which forms a lower support plate for said cushion and the second of which is pivotally supported at one end in overlapping relationship to said lower support plate of said facing pair of members and forms a cushion receiving chamber with said lower support plate of a variable size transversely of the path of travel of said cushion, said second plate-like member normally lying at an acute angle with said lower support plate with a second end of said second plate-like member being closer to said lower plate member than said one end whereby a cushion cover can be slipped from said second end of said second plate-like members over the facing pair of plate-like members in an unstressed condition and said plate-like members can expand relative to each other as said cushion moves between them inwardly of said cover thereby expanding the cover sufficiently to receive a cushion passed inwardly of the cover.

9. The cushion cover stuffing machine of claim 1 wherein said means for positioning said cover comprises means forming a cushion receiving chamber extending along the path of movement of said cushion which has a first entrance end for receiving said cushion and a second exit end for said cushion, with said chamber being of a variable cross-sectional area transverse the path of movement of said cushion from said first entrance end to said exit end, with said first entrance end forming an opening of relatively fixed size and said opposite end forming a relatively narrower opening with said chamber tapering from said first end to said second end when said chamber is empty, said chamber presenting an exterior surface transverse its length when said chamber is empty of a size peripherally less than the interior of said cover adjacent said second end whereby a cover can be readily slipped over said chamber and the closed end of the cover positioned near to said second end of said chamber.

10. A method of applying a seat cushion cover to a compressible cushion having a preshaped form defining the general exterior appearance of the cushion in its uncompressed state and wherein said cover complements said exterior appearance but compared to said cushion is smaller in overall size and relatively dimensionally fixed as compared to said cushion whereby said cushion can be enclosed by said cover only by compression of said cushion and forcing said cushion inwardly of said cover and said cover has an open end for receiving said cushion in a compressed state comprising of:

compressing said cushion to a reduced size transversely thereof, placing said cover with its opened end in position to receive said cushion while the latter is in said compressed state and is moved from a first position to a second position, forcing said cushion to move from said first position to said second position, expanding said cushion and said cover while said cushion is moving inwardly of said cover and said cover is relatively fixed in position, and when said cushion is fully received within said cover and said cover is fully expanded forcing said cover and cushion to move as a single unit by continued application of force to said cushion, and retaining said cover in a fixed position while said cushion is moving into said cover, and moving said cushion in compressed condition into said cover and expanding said cover while said cushion moves through said cover and said cover remains in a fixed position.

11. The method of applying a cover to a cushion of claim 10 including transmitting force from said cushion to said cover as it moves within said cover and while said cover remains in fixed position to expand said cover.

* * * * *